United States Patent [19]

Kirkpatrick

[11] 4,073,207

[45] Feb. 14, 1978

[54] LOCK FOR ROTARY DIE CUTTING BLANKET

[75] Inventor: Alan D. Kirkpatrick, Sparta, N.J.

[73] Assignee: Robud Co., Fairfield, N.J.

[21] Appl. No.: 753,304

[22] Filed: Dec. 22, 1976

[51] Int. Cl.[2] ..... B26D 7/20

[52] U.S. Cl. ..... 83/659; 29/129; 83/347

[58] Field of Search ..... 83/659, 347, 698; 29/118, 129; 24/201 C, 243 K; 101/415.1

[56] References Cited

U.S. PATENT DOCUMENTS

| | | | |
|---|---|---|---|
| 3,714,692 | 2/1973 | Bray | 29/129 |
| 3,765,329 | 10/1973 | Kirkpatrick et al. | 83/659 X |
| 3,882,750 | 5/1975 | Duckett et al. | 83/659 |
| 3,885,486 | 5/1975 | Kirkpatrick | 83/659 |

*Primary Examiner*—J. M. Meister

*Attorney, Agent, or Firm*—Carella, Bain, Gilfillan & Rhodes

[57] ABSTRACT

Locking means for a cutting die blanket is disclosed to include male and female locking elements which, when engaged, generate a state of compression in the blanket coating material such as to achieve uniform resistance to penetration throughout the surface of the blanket.

6 Claims, 4 Drawing Figures

LOCK FOR ROTARY DIE CUTTING BLANKET

BACKGROUND OF THE INVENTION

The present invention relates to locking means for flexible elements. More particularly, the present invention relates to locking means for a flexible element to be wrapped and secured in cylindrical form. Typical of such elements is a cutting die blanket for use in conjunction with a cylindrical anvil roller in a rotary die cutting apparatus.

Rotary die cutting pertains to the art of cutting a moving workpiece, e.g. a continuously moving web or a sheet of material, without interrupting the movement of the workpiece. In typical application moving webs or sheets or material such as cardboard and corrugated paperboard are passed between a cutting roller and an anvil roller. Cutting elements known as cutting rules are mounted on the cutting roller for rotation therewith. The anvil roller is provided with a cylindrical cover known as a cutting die blanket which fits around the surface of the anvil roller and effectively increases its diameter by twice the blanket thickness. The axes of rotation of the cutting roller and the anvil roller are parallel and displaced by an amount such that at their points of closest proximity the cutting rules penetrate the surface of the die cutting blanket.

As the cutting rules penetrate the surface of the die cutting blanket a resistance to the penetration is developed which, for purposes of this application, is called a reaction force. Adjustment of the relative positions of the axes of rotation of the cutting die roller and the anvil roller is made to provide a degree of penetration and therewith a degree of reaction force sufficient to insure complete cutting of the moving web of material.

As will be recognized by those experienced in these arts, the amount of reaction force generated is not a function solely of the degree of penetration of the cutting rule but also of the resistance of the blanket material to penetration. Variations in the thickness of the blanket material have been a source of continuing difficulty for operators. More specifically, in order to insure that a complete cut is made each time a cutting rule comes in contact with a workpiece, the depth of penetration of the cutting rule into the blanket material is adjusted such as to generate adequate reaction force even at the points of least resistance to penetration notwithstanding that such low resistance areas comprise a relatively small portion of the blanket area. In order to insure adequate cutting over the entire blanket surface therefore, the depth of penetration for the major area of the die cutting blanket is greater than necessary thus causing excessive blanket damage and a shorter operating life.

It is for the foregoing reason that manufacturers of die cutting blankets employ techniques such as grinding and the like to insure a uniform thickness of blanket material thus minimizing the range of adjustment necessary to insure complete penetration and cutting of the workpiece.

One area of continuing difficulty, however, is the surface of the blanket in the vicinity of the joint. Known joints utilize securing means wherein the structure is such as to require a greater depth of blanket material. The utilization of certain of such blankets has resulted in the penetration setting being gauged to insure web cutting at the joint structure. The effect of this, as noted above, is unnecessarily deep penetration with attendant excessive wear over other areas of the blanket thus causing an unnecessarily short blanket life.

An approach to this problem has been to add additional material to the surface of the blanket above the joint area. Although prolonging the life of the blanket, this approach has caused a bump in the blanket resulting in objectionable vibrations and has also resulted in uneven blanket wear by reason of the intentional wear area developed at the joint. Further, where the bump in the blanket comes into register with a scoring die there has often resulted a cutting of the workpiece rather than the desired scoring. Needless to say such undesirable cutting results in significant losses.

There has also occurred unacceptable breakage of cutting rules by reason of the bumps heretofore described. Such breakage results from excessive pressures on the cutting rules by reason of the deep penetration of the "bumps."

SUMMARY OF THE INVENTION

It is an object of the present invention, therefore, to provide a die cutting blanket which presents a substantially perfectly cylindrical external surface when mounted on the anvil roller of a rotary cutting die apparatus.

A further object of the present invention is to provide a die cutting blanket which exhibits a uniform resistance to the penetration of the cutting rule throughout the entire surface of the die cutting blanket.

These objects and others not enumerated are achieved by the die cutting blanket of the present invention, one embodiment of which may include a split ring band having a female connector element secured to one end and a male connector element secured to its other end; a coating material disposed on and adhered to one surface of the split ring band, the coating material extending into and forming a portion of the male and female connector elements and projection means rigidly secured to the coating material and forming a part of the male connector to generate a state of compression in the coating of the female connector element when engaged therewith.

BRIEF DESCRIPTION OF THE DRAWINGS

A more complete understanding of the present invention may be had from the following detailed description thereof particularly when read in the light of the attached drawings, wherein.

DETAILED DESCRIPTION

As noted above, the present invention relates to flexible backing blankets and in particular cutting die blankets for use in conjunction with a cylindrical anvil roller in a rotary die cutting apparatus.

Figure 1:
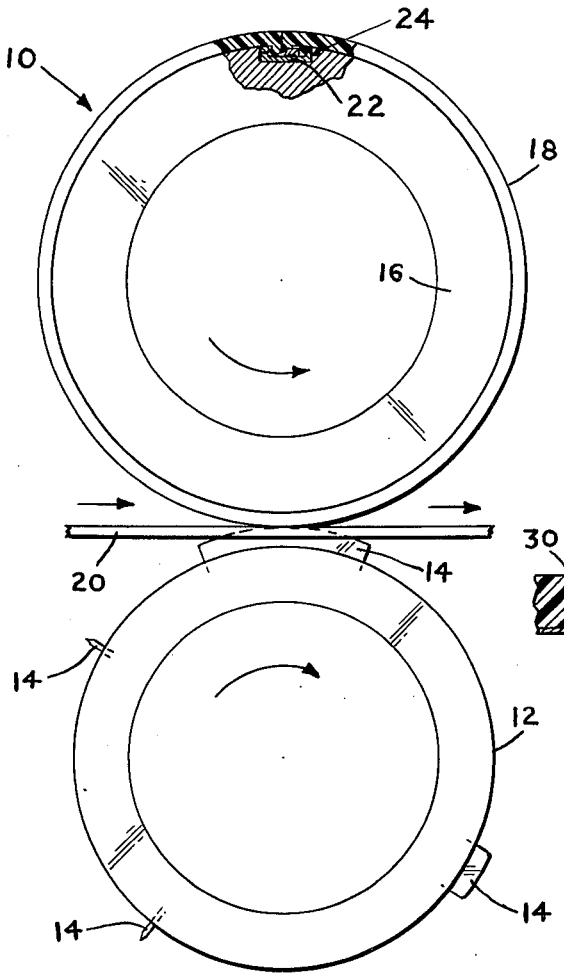
FIG. 1 is a schematic side elevational view of a rotary die cutting apparatus having a cutting die blanket incorporating locking structure according to the present invention.

Referring therefore to FIG. 1, there is shown schematically a rotary die cutting apparatus designated generally by the reference numeral 10. Die cutting apparatus 10 includes a cutting roller 12 having a plurality of cutting knives or rules 14 mounted thereon and an anvil roller 16 having mounted thereon a cutting die blanket 18 structured in accordance with the present invention.

Rotary die cutting apparatus 10 is shown in FIG. 1 to be cutting a web of material 20, e.g. cardboard, as it passes between rollers 12 and 16 from left to right as shown. Cutting roller 12 and anvil roller 16 rotate in the clockwise and counterclockwise directions, respectively, at an angular rate which is such as to cause their surface velocities to be identical at their common line of tangency to the speed of advance of web 20. This relationship permits cutting of the web material in what is substantially a radially directed in and out motion.

Formed in the periphery of anvil roller 16 is a slot 22 which extends transversely across the surface of roller 16 in a line generally parallel to the axis of rotation of roller 16. Slot 22 is adapted to receive the locking element 24 of cutting blanket 18 such as to secure blanket 18 rigidly to the anvil roller 16 for rotation and operation therewith. Thus, during set-up of apparatus 10, a cutting die blanket 18 according to the invention is wrapped around anvil roller 16 and positioned peripherally angularly such that locking structure 24 is received within slot 22.

Figure 2:
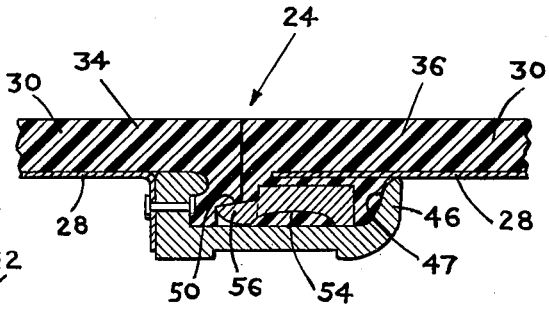
FIG. 2 is a cross-sectional elevational view of blanket locking structure according to the invention shown in the locked position.
Figure 3:
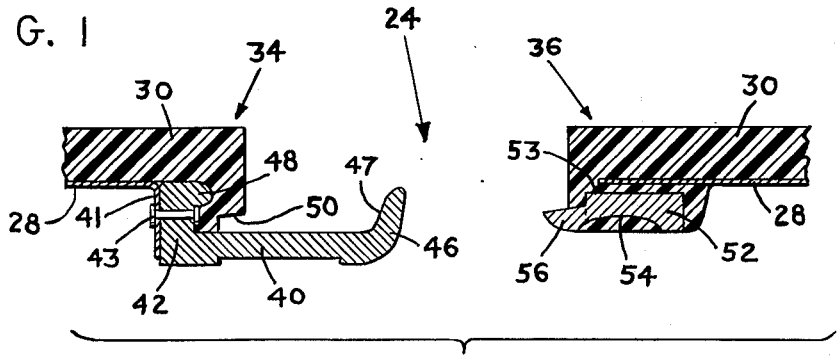
FIG. 3 is a cross-sectional elevational view similar to FIG. 2 but showing the blanket locking structure in the unlocked position.
Figure 4:
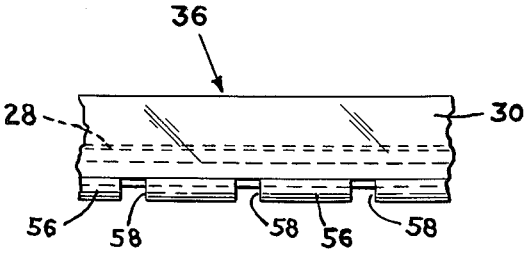
FIG. 4 is a partial end elevational view of one end of locking element.

Referring now to FIGS. 2, 3 and 4, there is shown in partial cross-sectional elevation a cutting die blanket 18 incorporating locking structure 24 according to the present invention.

Blanket 18 comprises a split ring annular band 28 having a composite coating 30 thereon, the ends of each forming a portion of the locking structure 24. Split ring band 28 may be fabricated from any of the flexible materials which are known conventionally to be employed as backings for cylinder covers, e.g. thin sheet metal, thin fiber sheets, wire reinforced rubber or the like. A typical band dimensionally can be expected to be up to 60 inches long and from 8 to 12 inches wide. In this regard the dimensions of any particular band or series of bands are determined by the dimensional characteristics of the anvil rollers for which they are to be used.

The blanket material 30, i.e. the composite coating, can be chosen from any of the known blanket materials such as polyurethane, polyvinyl chloride, chlorinated butyl rubber and the like. The blanket material is bond-cast onto the surface of band 28 whereafter the desired uniform thickness is achieved by precision grinding.

As is clear from the drawings, the blanket material is integral with and forms a part of the locking structure 24. With particular reference to FIG. 3, the locking structure 24 of the blanket 18 can be seen to comprise a female section designated generally by the reference numeral 34 and a male section designated generally by the reference numeral 36.

Female section 34 comprises a generally U-shaped channel 40 to which is bonded the blanket material 30 and to which is mechanically secured split ring band 28. More specifically, split ring band 28 is bent as its end to form a flange 41 which is in surface-to-surface engagement with an outer surface of one wall 42 of channel 40. Flange 41 and channel 40 are rigidly secured by a plurality of transversely spaced rivets 43 which extend through suitable openings formed in flange 41 and the wall 42 of channel 40.

It should be noted that split ringband 28 and channel 40 are secured by rivets 43 prior to the molding of blanket material 30 thereon in order to permit the swaging of the inner ends of the rivets. It will be recognized by those skilled in these arts that other securing means than rivets may be used. It should also be noted that the walls of channel 40 include a thicker wall 42 to which flange 41 is secured and a thinner wall 46, the inner surface 47 is tapered inwardly from top to bottom. As is discussed below in detail, the taper of surface 47 assists in providing a secure lock when section 36 is received within section 34.

The upper inner surface of channel wall 42 is provided with a radius shoulder 48 which is provided to improve the mechanical bond between channel 40 and the material of blanket 30. As best may be seen in FIG. 3, the material of blanket 30 is cast such that it extends partially over and fully downwardly into the open portion of channel 40. Thus all of shoulder 48 is encapsulated as well as all the upset heads of rivets 43.

The lower end of the blanket material 30 is relieved to define a channel 50 within which may be received a detent of the male locking element 36 all as discussed below in detail. In this regard, and with particular reference to FIGS. 3 and 4, male locking element 36 can be seen to comprise a generally U-shaped channel 52, the end of split ringband 28 opposite that of flange 41 and an extension of the material of blanket 30.

Channel 52 comprises an elongated generally U-shaped member having an upper flat surface 53, a relieved semi-eliptical lower surface 54 defining a cavity and a shoulder 56 which extends outwardly of channel 52 toward female section 34. As best may be seen in FIG. 4, shoulder 56 is relieved at a plurality of transversely spaced positions 58 to permit communication of the cavity defined by surface 54 with the space above projection 56. As also best may be seen in FIG. 3, the lower surface of projection 56 is rounded and the upper surface is tapered. As is discussed below in greater detail, the lower surface of projection 56 is rounded to facilitate insertion and positioning of element 36 within element 34, and the upper surface of projection 56 is tapered to bear against the upper surface of channel 50 causing deformation and secure locking.

Male locking section 36 is manufactured together with the casting of the full die cutting blanket. Thus, channel 52 is positioned to be generally under and slightly spaced from the lower surface of split ringband 28. The parts are coated with an adhesive and thereafter the blanket material is introduced into the appropriate die such as to encapsulate totally channel 52 except for its lower wall surfaces, the lower surface of projection 56 and a portion of the upper surface of projection 56 all shown in the drawing. In this regard, full flow of material into the cavity defined by surface 54 is accommodated by openings 58 formed in projection 56.

Referring now to FIG. 2, the assembly of male and female locking sections 36 and 34 is shown. More specifically, it can be seen from FIG. 2 that in the assembled position projection 56 is inserted into channel 50 and the inside surface of male section 36 is in surface-to-surface engagement with the inclined surface 47 of wall 46. The respective structures are dimensioned such that the assembly of the sections into the locked position causes a general compression of the blanket material. This compression of the blanket material develops a resistance to displacement, particularly in the area between the ends of split ringband 28 above projection 56. The resistance to displacement resulting from the compressed state of the material causes the blanket material in this area to react substantially identically to the reaction of the remaining blanket material which is not so compressed but which is supported at a rather shallow depth by split ringband 28. Accordingly, by reason of the resulting constant resistance to the entry of cutting rules during operation of the rotary die cutter, the depth of entry of the rule may be adjusted to be only that necessary to generate adequate cutting force throughout the entire surface of the blanket because the entire surface of the blanket now exhibits a constant resistance to deformation.

As will be evident to those having skills in these arts, the structure of the cutting blanket of the present invention comprises a novel approach to achieving longer life and greater efficiency of blanket. Such longer life reduces down time on the rotary die cutting apparatus and improves its overall operation and cost efficiency.

It will also be recognized by those having skills in these arts that many modifications and variations may be made to the present invention without departing from the spirit and the scope thereof.

What is claimed is:

1. A cutting die blanket for use with an anvil roller of a rotary die cutting apparatus comprising:

a split ring band having a first end and a second end;

a female connector element secured to said first end of said split ring band;

a male connector element rigidly secured to said second end of said split ring band;

a coating material disposed on and securely adhered to one surface of said split ring band, said coating material extendng into and forming a portion of each of said male and female connector elements; and projection means rididly secured to said coating material, said projection means including a tapered surface, said tapered surface forming a part of said male connector and cooperating with said female connector element to generate a state of compression in the coating of said female connector element when engaged therewith, said compression being such as to create a resistance to penetration in the coating material of said male and female connector elements which is substantially equal to the resistance to penetration exhibited by said coating material over the remaining surface of said die cutting blanket.

2. A cutting die blanket according to claim 1 wherein said female connector element comprises a generally U-shaped channel rigidly secured to said split ring band, said U-shaped channel for receiving said male connector element, and a channel formed in said coating material of said female connector element, said channel for receiving said projection means of said male connector element.

3. A cutting die blanket for use with an anvil roller of a rotary die cutting apparatus comprising:

a split ring band having a first end and a second end;

a female connector element secured to said first end of said split ring band;

a male connector element rigidly secured to second end of said split ring band, said male connector element comprising a generally U-shaped channel;

a coating material disposed on and securely adhered to one surface of said split ring band, said coating material extending into and forming a portion of each of said male and female connector elements, said coating material substantially encapsulating said U-shaped channel of said male connector element; and projection means integral with said U-shaped channel and extending outwardly therefrom beyond said encapsulating coating material, said projection means forming a part of said male connector to generate a state of compression in the coating of said female connector element when engaged therewith, said compression being such as to create a resistance to penetration in the coating material of said male and female connector elements which is substantially equal to the resistance to penetration exhibited by said coating material over the remaining surface of said die cutting blanket.

4. A cutting blanket for use with an anvil roller of a rotary die cutting apparatus comprising:

a split ring band having a first end and a second end;

a male connector element rigidly secured to said second end of said split ring band, said male connector element including a generally U-shaped channel;

a female connector element secured to said first end of split ring band, said female connector element comprising a generally U-shaped channel rigidly secured to said split ring band, said U-shaped channel of said female connector element for receiving said male connector element;

a coating material disposed on and securely adhered to one surface of said split ring band, said coating material extending into and forming a portion of each of said male and female connector elements, said coating material substantially encapsulating said U-shaped channel of said male connector element, and said coating material of said female connector element having a channel formed therein, said channel formed in said female connector element for receiving said projection means of said male connector element; and projection means integral with said U-shaped channel of said male connector element, said projection means extending outwardly therefrom beyond said encapsulating coating material and forming a part of said male connector to generate a state of compression in the coating of said female connector element when engaged therewith, said compression being such as to create a resistance to penetration in the coating material of said male and female connector elements which is substantially equal to the resistance to penetration exhibited by said coating material over the remaining surface of said cutting blanket.

5. A cutting die blanket according to claim 4 wherein said projection means includes a tapered surface thereon, said tapered surface for cooperating with said channel in said coating material of said female connector element to generate a state of compression in said coating material of said female connector element.

6. A cutting die blanket according to claim 5 wherein said projection means includes an upper surface and a lower surface, said upper surface being said tapered surface and wherein said lower surface is curved to permit relatively easy entry of said projection into said channel in said coating material of said female connector during locking of said device.

* * * * *